United States Patent [19]

Schulz et al.

[11] 4,449,468

[45] May 22, 1984

[54] ADJUSTABLE ROLLER FURLING SPAR

[75] Inventors: Walter A. Schulz, Portsmouth; John H. Procter, East Providence, both of R.I.

[73] Assignee: Schulz Marine Systems, Inc., Bristol, R.I.

[21] Appl. No.: 495,960

[22] Filed: May 19, 1983

[51] Int. Cl.[3] ..... B63H 9/10

[52] U.S. Cl. ..... 114/104; 114/97

[58] Field of Search ..... 114/104, 105, 106, 107, 114/108, 109, 112, 102, 103; 242/110, 77.2, 72 R, 73; 160/263, 246, 262; 267/69; 15/233, 230.17, 230.18, 230.19

[56] References Cited

U.S. PATENT DOCUMENTS

| | | | |
|---|---|---|---|
| 280,808 | 7/1883 | Fox | 160/262 |
| 1,647,813 | 11/1927 | Reckmann | 114/112 |
| 3,260,230 | 7/1966 | Kauert | 114/106 |
| 3,608,511 | 9/1971 | Katshen | 114/106 |
| 3,980,036 | 9/1976 | Crall | 114/106 |
| 4,324,192 | 4/1982 | Ingouf | 114/106 |

FOREIGN PATENT DOCUMENTS

| | | | |
|---|---|---|---|
| 52835 | 3/1911 | Austria | 114/107 |

*Primary Examiner*—Trygve M. Blix
*Assistant Examiner*—Patrick W. Young
*Attorney, Agent, or Firm*—Salter & Michaelson

[57] ABSTRACT

An adjustable roller furling spar includes an elongated base member which is securable on a sailboat and an adjustable periphery assembly which is attached to the base member and coextends a distance therewith. The periphery assembly is adjustable to define an effective winding cross-section of the spar which is variable along the longitudinal extent thereof and which is operable for windingly receiving a sail on the spar. By properly adjusting the periphery assembly, it is operable to compensate for irregular stretch in older sails when the spar is used for reefing so that even a badly stretched sail can be maintained in a substantially flat disposition.

22 Claims, 13 Drawing Figures

ADJUSTABLE ROLLER FURLING SPAR

BACKGROUND AND SUMMARY OF THE INVENTION

The instant invention relates to sail boats and more particularly to a novel adjustable roller furling spar for a sail boat which is adjustable to compensate for irregular stretch in a sail.

The use of roller furling spars, including roller furling masts and booms, is generally known in the sailing field. In this connection, several varieties of roller furling spar constructions have heretofore been available which include longitudinally extending rotatable elements for windingly receiving sails thereon. Many of the heretofore available roller furling spar constructions have been operable for furling sails thereon as well as for reefing sails to maintain them in "partially furled" dispositions. Obviously, devices of this type are used for furling sails in order to prepare them for storage or for when wind and/or sea conditions make it necessary or desirable to operate the respective vessels, to which they are attached, with the sails thereof in fully lowered dispositions. Devices of this type are used for reefing sails under circumstances, such as heavy wind conditions, when it is necessary or desirable to maintain sails in a "partially furled" disposition to reduce the effective areas thereof. Many of the heretofore known devices of this type have been constructed to be operable under sea conditions so that the sail areas of the respective vessels can be adjusted to compensate for changes in wind conditions.

Spar constructions which are generally exemplary of the furling spars hereinabove described and which represent the closest prior art to the instant invention of which the applicant is aware are disclosed in the to Fearon, U.S. Pat. No. 308,146, Tatchell, U.S. Pat. No. 879,986, Tamm, U.S. Pat. No. 2,119,475, Beaudry, U.S. Pat. No. 2,197,654, Wells-Coates, U.S. Pat. No. 2,561,253, and Ingouf, U.S. Pat. No. 4,324,192. However, while these patents teach various types of furling and reefing spar constructions, they do not even remotely teach or suggest the novel furling spar of the instant invention which is adjustable to compensate for irregular stretch in older sails, and hence they are of nothing more than general interest.

A problem heretofore encountered with many sail boats, including sail boats having conventional spar constructions as well as those having furling spars, is the tendency of sails to stretch irregularly as they become older, whereby they become significantly less efficient. In this connection, conventional sails generally comprise a plurality of trapezoidal panels which are sewn together to define a triangular sail configuration. The individual panels themselves frequently stretch irregularly and the areas of interconnection between the panels where they are sewn or stitched together also tend to stretch irregularly. Frequently, the result is that after a sail has been used for two or three years, "baggy" areas appear therein which are caused by irregular stretching. Further, the more a sail is used, the worse this condition becomes, and hence after a sail has been used for several years it can become significantly distorted from its original shape and have several areas which are quite "baggy". These baggy areas not only have disadvantages from an aesthetic standpoint but they also significantly reduce the efficiency of the sail. Heretofore, this problem has not been adequately addressed by the sailing industry and hence the only solution has been to replace older sails when they become distorted or "baggy".

The adjustable roller furling spar of the instant invention, which is operable for both furling and reefing of sails, provides a novel solution to the above mentioned problem of irregular stretch in sails when it is used for the reefing thereof and it also provides solutions to several other problems that have heretofore existed with the known roller furling spar constructions. In this regard, the roller furling spar of the instant invention is adjustable so that it compensates for irregular sail stretch when it is used for reefing, and comprises an elongated, substantially rigid spar base member which is rotatably securable on a sail boat, an adjustable periphery assembly which is attached to the base member and adjustably defines an effective winding cross section of the spar which is adjustable along longitudinally extent thereof, and means for rotating the spar base member and the periphery assembly attached thereto and for adjustably securing them in various rotated dispositions. Upon rotation of the spar, a sail attached thereto is windingly received on the adjustable periphery assembly and since the periphery assembly is adjustable to vary the effective winding cross section thereof along its longitudinal extent, it can be adjusted to compensate for varying degrees of stretch or "bagginess" in various areas of the sail. For example, when an area of "bagginess" appears in a sail, the portion of the spar directly therebeneath can be adjusted to increase the effective winding cross section of the spar in this area so that an additional amount of sail material is wound on the spar in the area of increased cross section to tighten the "baggy" area. In most instances it is only necessary to make such adjustments at the beginning of each boating season since the degree of stretch which normally occurs during a single season is relatively small. After the periphery assembly has been properly adjusted, the spar is operable similar to a conventional furling spar. However, when it is used for reefing a sail, it can maintain even a badly stretched sail in a tight and trim disposition.

The embodiment of the adjustable roller furling spar of the instant invention in spars of various types including masts and booms is contemplated. However, the preferred embodiment of the instant invention comprises an adjustable roller furling boom which also comprises several other features which provide further advantages over the furling spar constructions of the prior art. Specifically, the adjustable roller furling boom of the instant invention preferably further comprises an elongated cowling comprising a pair of elongated substantially rigid shell portions which are mounted on the spar so that they cooperate to define an elongated housing which is slightly outwardly spaced from the adjustable periphery assembly of the spar, the upper edges of the shell portion being in spaced relation to define an elongated longitudinal opening on the upper side of the cowling for receiving a sail on the spar. The shell portions are preferably mounted so that they are resiliently outwardly movable to increase the transverse dimension of the longitudinal opening and so that the lower portions of the shell portions are outwardly pivotable to provide access to the adjustable periphery assembly. The preferred embodiment of the adjustable boom of the instant invention further comprises a rotatable shaft which is securable to a mast so that it extends forwardly therethrough. The spar base member is secured to the aft end of the rotatable shaft so that it is universally pivotable relative thereto, and the rotating assembly for rotating the boom is secured to the rotatable shaft in front of the mast. The rotating assembly preferably comprises a bevel gear mounted on the rotatable shaft and a rotatable worm gear which communicates with the bevel gear to rotate the shaft. Accordingly, the spar is rotatable with the worm and bevel gear assembly and securable in various rotated dispositions therewith. Also in the preferred embodiment, a halyard spool is provided on the rotatable shaft for windingly receiving a halyard attached to a sail thereon as the sail is unwound from the adjustable boom. The halyard spool is preferably dimensioned to receive the halyard thereon at substantially the same rate as the rate at which the sail is unwound from the boom, whereby as the sail is sequentially unwound, it will be raised up the mast a corresponding amount. Another feature of the preferred embodiment of the instant invention is a sail guide which is securable on a mast of the type having a bolt rope tunnel therein. The sail guide comprises a generally triangular plate portion having a bolt rope tunnel along one edge thereof and means which hingedly mounts the plate portion on the lower portion of the mast in spaced relation above the boom. The plate portion is mounted so that the bolt rope tunnel thereof communicates with the bolt rope tunnel of the mast and extends downwardly and generally rearwardly therefrom. Accordingly, the sail guide is operable to guide the fore bolt rope edge of a sail onto a roller furling boom as the boom is rotated and since it is hingedly mounted on the mast, as the sail is wound on the spar, the guide hinges outwardly to properly guide the sail on the spar as the winding diameter thereof is increased by the sail itself as it is wound thereon.

Accordingly, it is a primary object of the instant invention to provide a roller furling spar which can be adjusted to compensate for stretching in older sails when using for reefing.

Another object of the instant invention is to provide an adjustable roller furling boom which includes an adjustable periphery assembly whereby the effective winding cross section of the boom can be adjusted along the longitudinal extent thereof.

Still another object of the instant invention is to provide a furling boom having an outer cowling.

A still further object of the instant invention is to provide a spar assembly which includes a furling boom and a sail guide for guiding the fore end of a sail onto the furling boom.

An even further object of the instant invention is to provide a rotatable furling boom having a halyard spool for windingly receiving a halyard attached to a sail thereon as the sail is unwound from the furling boom.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
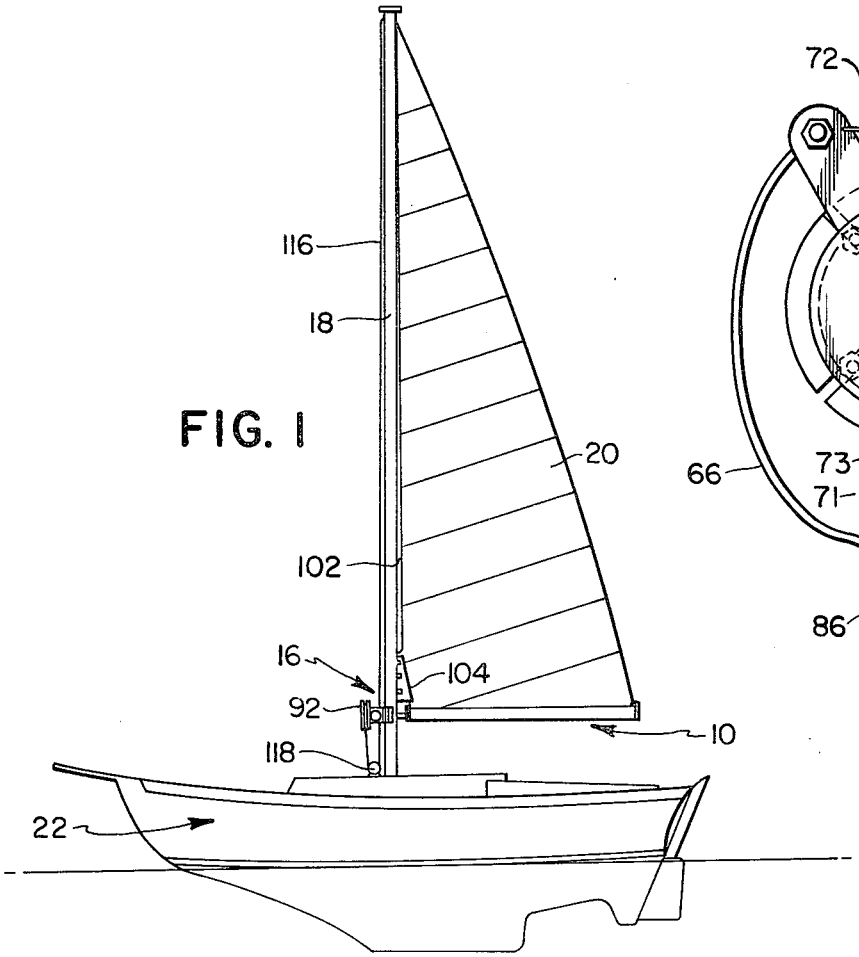
FIG. 1 is a side elevational view of a sail boat which includes the furling boom of the instant invention.
Figure 2:
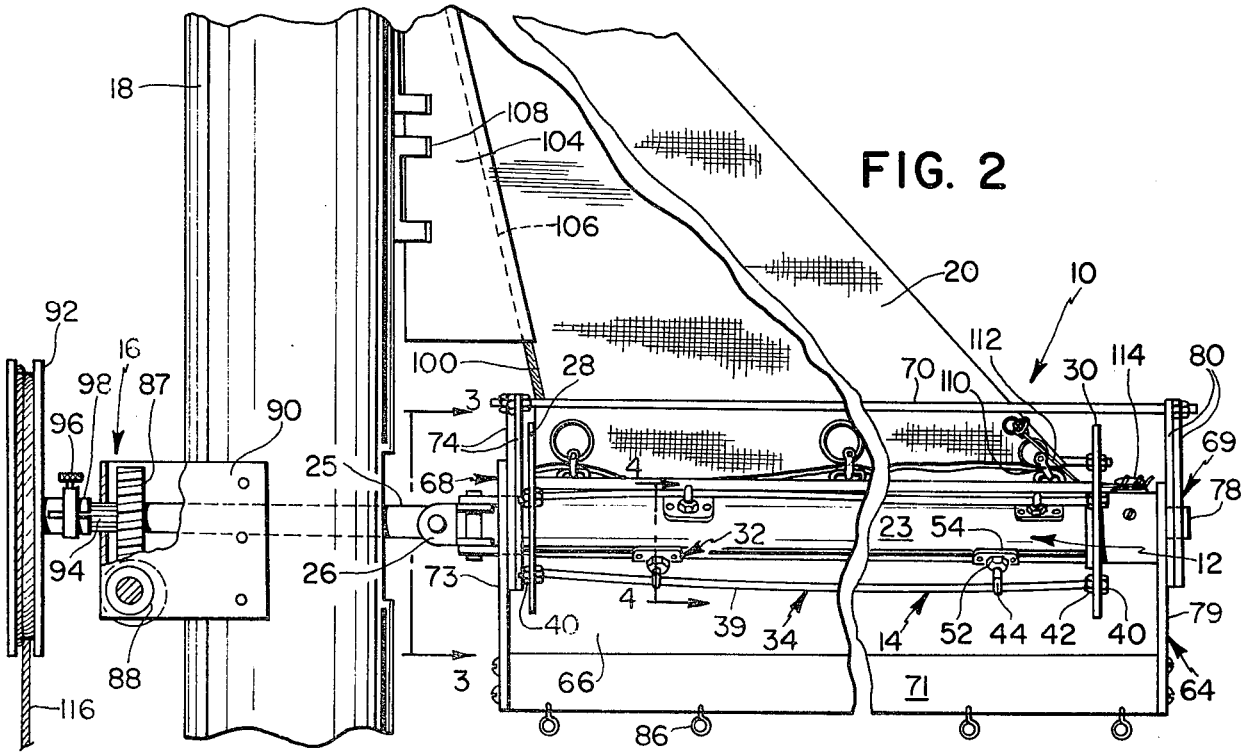
FIG. 2 is an enlarged fragmentary view of the boom and lower portion of the mast.

Referring now to the drawings, the adjustable roller furling spar of the instant invention embodied as an adjustable roller furling boom is illustrated in FIGS. 1–6, 10, 12, and 13, and generally indicated at 10 in FIGS. 1 and 2. As illustrated most clearly in FIG. 2, the adjustable roller furling boom 10 comprises a substantially rigid base member 12 having an adjustable periphery assembly generally indicated at 14 which is attached thereto and which extends longitudinally thereof, and a rotating assembly generally indicated at 16 for rotating the spar base member 12 and the adjustable periphery assembly 14 attached thereto. As illustrated in FIG. 1, the boom 10 is mounted on a mast 18 having a sail 20 attached thereto, the mast 18, the sail 20 and the boom 10 comprising part of a sail boat generally indicated at 22. The boom 10 is adjustable to vary the effective winding cross sectional area thereof along the longitudinal extent thereof, whereby it can be adjusted to compensate for the effects of irregular stretching in the sail 20 when it is used for the reefing thereof. More particularly, the boom 10 is adjustable so that when it is used for reefing the sail 20 it will maintain the exposed portion of the sail 20 in a substantially flat, taut disposition despite the fact that the sail 20 may be irregularly stretched in various areas thereof.

Figure 4:
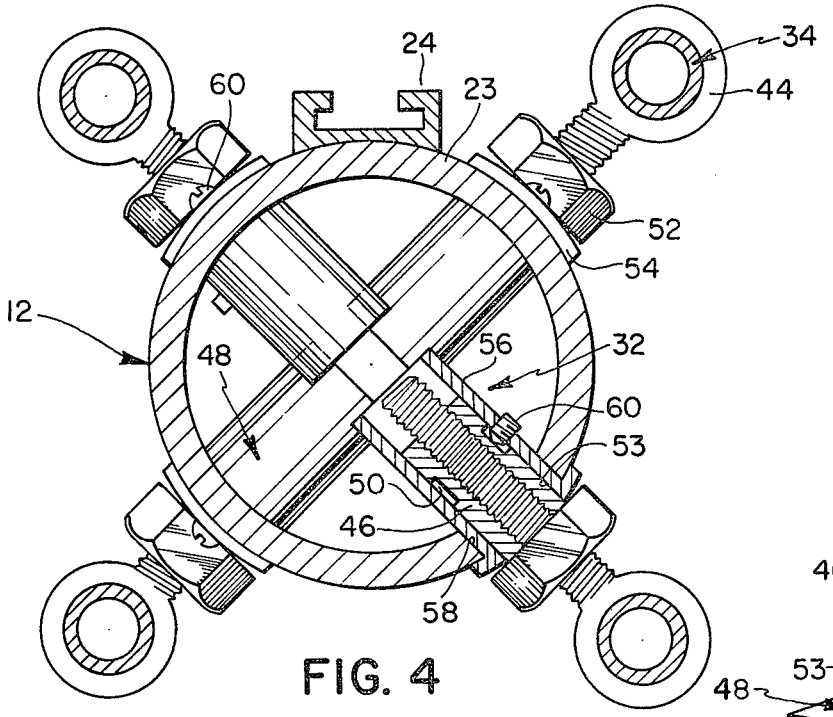
FIG. 4 is an enlarged sectional view taken along line 4—4 in FIG. 2.
Figure 6:
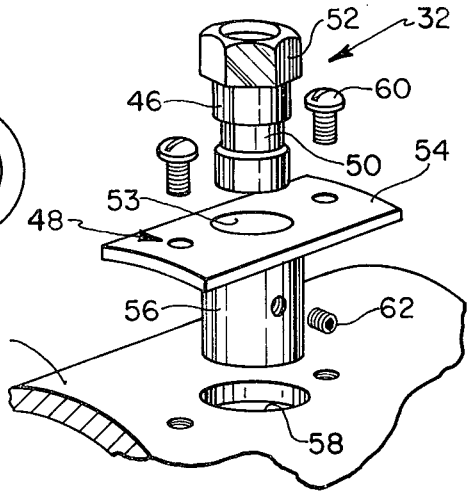
FIG. 6 is an enlarged fragmentary perspective view of the aft portion of the boom.
Figure 6:
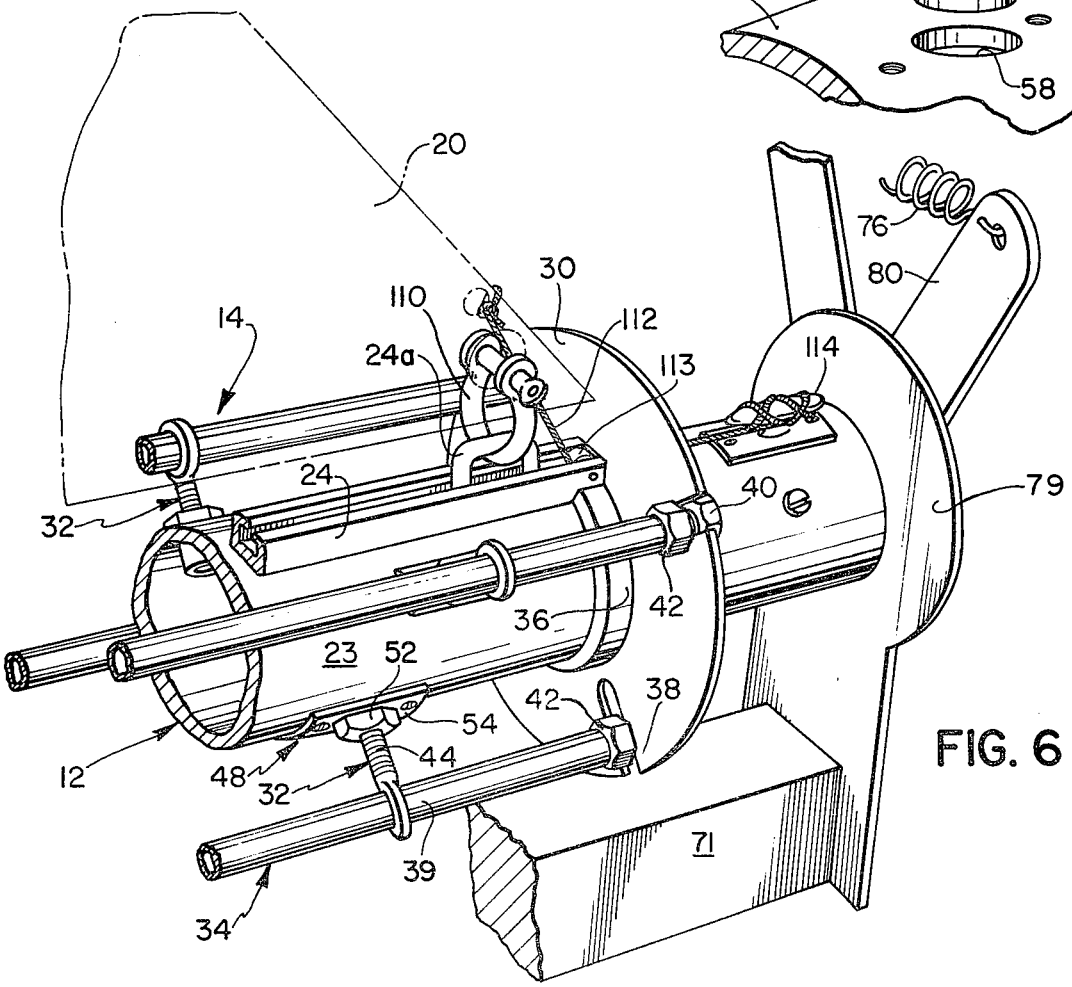

As illustrated most clearly in FIGS. 2, 4, and 6, the base member 12 comprises an elongated substantially rigid tubular member 23 having a track 24 secured thereto so that it coextends along the upper side thereof, the member 23 and the track 24 preferably being made of aluminum or some other suitable noncorrosive metal. Slidably received in the track 24 are a plurality of slide loops **24*a* for securing the sail 20 to the base member 12. A shaft 25 is rotatably secured to the mast 18 so that it extends forwardly therethrough and a universal 26 secures the base member 12 to the shaft 25 so that the base member 12 is universally pivotable relative to the mast 18. The rotatable shaft 25 and the universal 26** are also preferably made of suitable noncorrosive metals.

The adjustable periphery assembly 14 is illustrated in FIGS. 2–6, 9 and 10. The periphery assembly 14 comprises fore and aft retaining plates 28 and 30, respectively, which are secured to the base member 12 adjacent opposite ends thereof, a plurality of eye bolt assemblies generally indicated at 32 which are also secured to the base member 12 and a plurality of elongated slightly flexible rods 34 which are of slightly adjustable lengths. The eye bolt assemblies 32 are disposed on the base member 12 so that they extend substantially radially outwardly therefrom in staggered relation in substantially aligned longitudinal rows which are spaced around the base member 12. The rods 34 extend slidably through the aligned rows of eye bolt assemblies 32 and are thereby positioned so that they coextend with the base member 12 in slightly outwardly spaced relation thereto. The eye bolt assemblies 32 are, however, adjustable to vary the amounts of spacing between the rods 34 and the base member 12 as will hereinafter be more fully set forth. Further, since the rods 34 are slightly bendable or flexible, the eye bolt assemblies 32 can be adjusted to vary the positions of the rods 34 relative to the base member 12 along the longitudinal extents of the rods 34.

The retaining plates 28 and 30 are of substantially circular configuration and, as illustrated in FIGS. 2 and 6, are secured to the base member 12 with collars 36. Provided in the plates 28 and 30 are spaced radial slots 38 which are substantially aligned with the rows of eye bolt assemblies 32 in the periphery assembly 14.

The rods 34 preferably comprise elongated tubular members 39 which are preferably made of aluminum or some other noncorrosive metal and which have slide members 40 slidably received in the ends thereof. The slide members 40, which are herein embodied as bolts having nuts 42 thereon, are received in the slots 38 in the retaining plates 28 and 30 and are adjustably retained therein with the nuts 42. The threaded end portions of the bolts 40 are slidably received in the tubular members 39 to retain the ends thereof adjacent plates the 28 and 30 while providing slight adjustability in the lengths of the rods 34 which is necessary to compensate for the bending of the rods 39 when the assembly 14 is adjusted.

Figure 5:
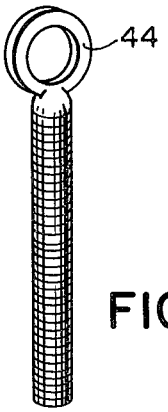
FIG. 5 is an exploded perspective view of one of the adjustable eye bolt assemblies of the boom.

The eye bolt assemblies 32 are most clearly illustrated in FIGS. 4 and 5, and comprise threaded eye bolt members 44, threaded sleeves 46, and socket elements 48. The threaded sleeves 46 are of generally cylindrical outer configuration having circumferential grooves 50 therein and enlarged hexagonal heads 52. The socket elements 48 have longitudinal bores 53 therein and include plate portions 54 which are adapted to conform to the outer configuration of the tubular member 23, and cylindrical socket portions 56. The socket elements 48 are secured to the base member 12 with the socket portions 56 received in apertures 58 in the tubular member 23 so that the plate portions 54 abut the outer surface of the tubular member 23. Threaded screws 60 secure the socket elements 48 to the tubular member 23. The sleeves 46 are rotatably received in the bores 53 so that the heads 52 bear on the plate portions 54, and set screws 62, which are threadedly received in the socket portions 56, extend into the grooves 50, whereby the sleeves 46 are rotatably retained in the socket elements 48. The eye bolt members 44 are threadedly received in the sleeves 46, it being apparent that by rotating the sleeves 46 relative to the eye bolt members 44, the outward extents of the eye bolt members 44 relative to the base member 12 can be adjusted. In this connection, since the rods 34 extend through the eye bolt members 44, the eye bolt members 44 themselves cannot be rotated. However, since the sleeves 46 are rotable in the socket elements 48, adjustments in the outward extents of the eye bolt members 44 can be effected by rotating the hexagonal heads 52.

Figure 3:
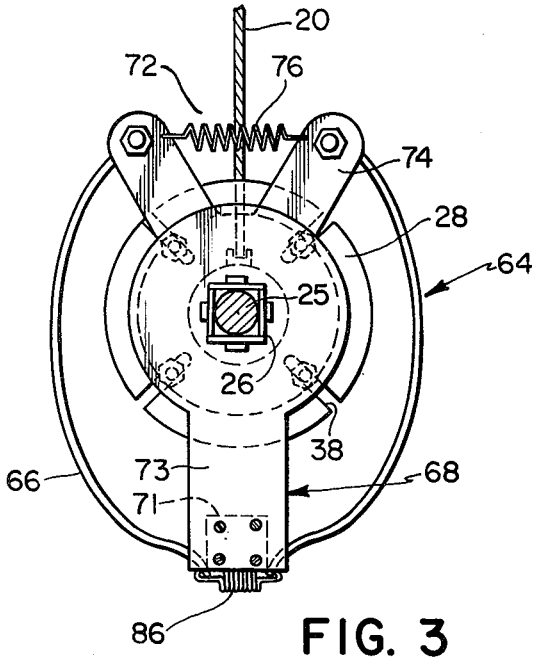
FIG. 3 is a sectional view taken along line 3—3 in FIG. 2.
Figure 12:
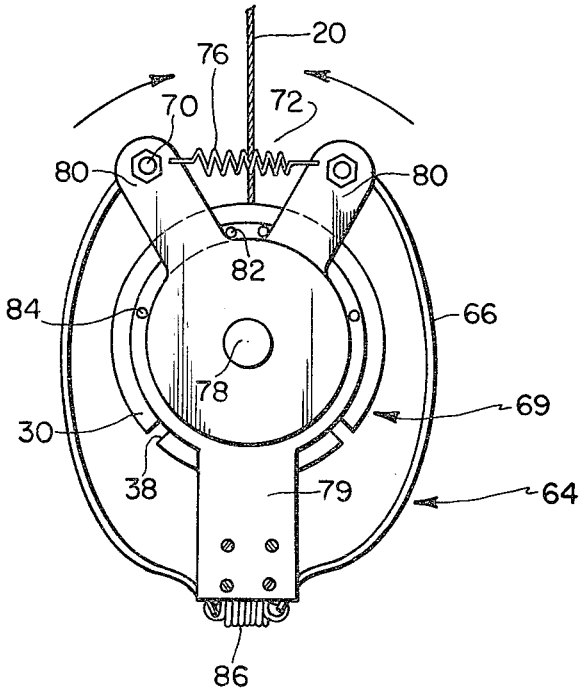
FIG. 12 is an end view of the boom.
Figure 13:
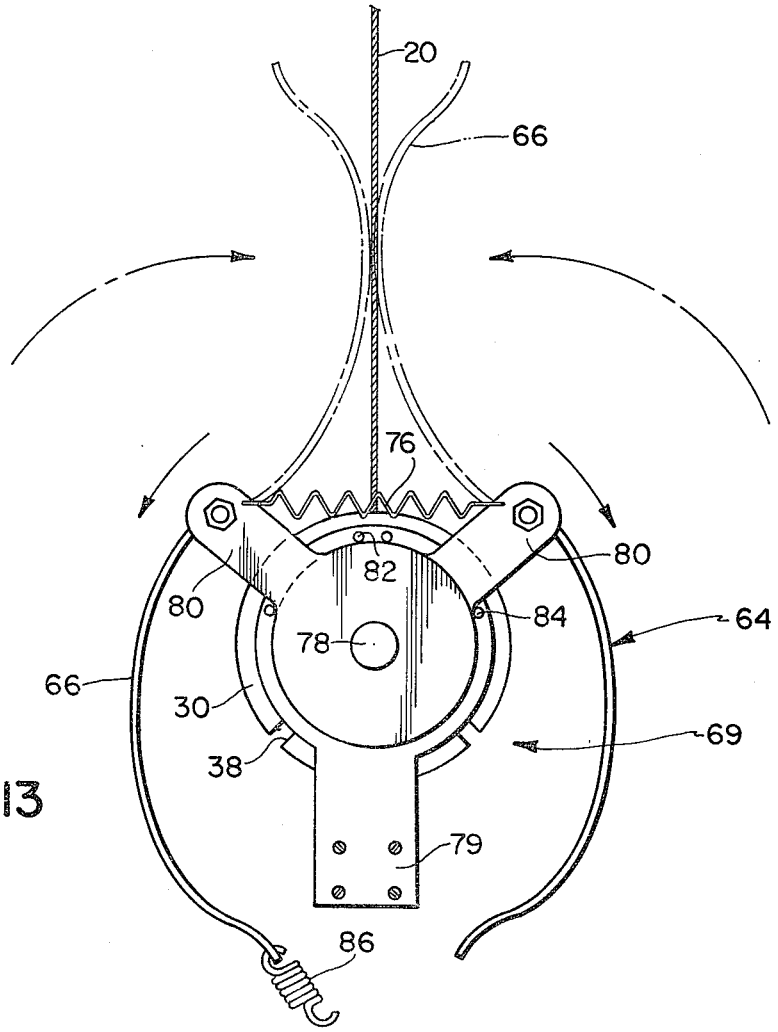
FIG. 13 is a similar view illustrating the operation of the boom cowling.

The preferred embodiment of the boom 10 further comprises a cowling assembly which is illustrated in FIGS. 2, 3, 6, 12 and 13, and generally indicated at 64. The cowling assembly 64 comprises a pair of elongated shell portions 66 of arcuate cross section, fore and aft mounting assemblies generally indicated at 68 and 69, respectively, which are rotatably received on the base member 12 adjacent the fore and aft ends thereof, respectively, a pair of elongated rods 70 which extend between the mounting assemblies 68 and 69 and a lower beam element 71 which also extends between the mounting assemblies 68 and 69. The shell portions 66, which define an elongated longitudinal opening 72 along the top of the cowling assembly 64, are preferably made of a suitable rigid light weight material such as fiberglass and are secured to the rods 70 so that they hang generally downwardly therefrom. The mounting assembly 68 is most clearly illustrated in FIGS. 2 and 3, and comprises a main bracket 73 which is rotatably received on the fore end of the base member 12 and extends downwardly therefrom, and a pair of scissor arms 74 which are received on the base member 12 adjacent the bracket 73 so that they are independently rotatable relative to the base member 12 to provide a scissors action between the arms 74. A coil spring 76 extends between the scissor arms 74, and inner and outer stop pins (not shown) which extend from the bracket 73, define the limits of the pivotable movement of the arms 74 so that the inner stop pins and the coil spring 76 cooperate to normally maintain the arms 74 in the relative dispositions thereof illustrated in FIG. 3 but so that they may be outwardly pivoted against the bias of spring 76 to the extent permitted by the outer stop pins. The aft mounting assembly 69 is illustrated in FIGS. 2, 12 and 13, and is substantially the same as the fore mounting assembly 68 except that it is rotatably received on a reduced shaft 78 which is secured in the aft end of the base member 12 and extends rearwardly therefrom. The assembly 69 comprises a bracket 79 and a pair of scissors arms 80 which are rotatably mounted on the shaft 78, the arms 80 being substantially the same as the scissors arms 74. A coil spring 76 extends between the arms 80 and inner and outer stop pins 82 and 84, respectively, extend from the bracket 79 and are engageable by the arms 80 to define the inner and outer extents of the pivotal movement thereof. The inner and outer pins 82 and 84, respectively, are substantially the same as the corresponding pins (not shown) on the bracket 73 in the fore mounting assembly 68. The beam 71 extends between the lower portions of the brackets 73 and 79 of the fore and aft mounting assemblies 68 and 69, respectively, and the rods 70 extend between the fore and aft scissors arms 74 and 80, respectively, on the same respective sides of the base member 12. Accordingly, the rods 70, from which the shell portions 66 are suspended, interconnect the arms 74 and 80 on the same sides of the base member 12, whereby the transverse dimension of the elongated longitudinal opening 72 in the cowling 64 which is defined by the rods 70 and the upper extremities of the shell portions 66, is resiliently expandable as illustrated in FIG. 13. As illustrated in FIGS. 3 and 12, the lower extremities of the shell portions 66 normally engage the beam 71 and are resiliently retained adjacent thereto with detachable coil springs 86. However, upon detachment of the coil springs 86, the shell portions 66 can be pivoted upwardly as illustrated in broken lines in FIG. 13 to provide access to the base member 12 and the adjustable periphery assembly 14. It should also be pointed out that since the entire cowling assembly 64 is actually relative to the base member 12 to allow the base member 12 and the periphery assembly 14 to be rotated to receive the sail 20 thereon, the sail 20 which extends through the elongated opening 72 actually prevents the cowling 64 from rotating around the base member 12.

Referring further to FIG. 2, as hereinabove mentioned, the rotatable shaft 25 extends forwardly through the mast 18. It will be understood that conventional means (not shown) will be provided to rotatably secure the shaft 25 to the mast 18 so that the base member 12, the periphery assembly 14 and the cowling assembly 64 are maintained in closely spaced relation to the aft thereof. Mounted on the shaft 25 in front of the mast 18 is a bevel gear 87 which communicates with a worm gear 88 rotatably mounted in a housing 90 attached to the mast 18. A handle (not shown) is attached to the worm gear 88 to effect rotation thereof, which rotation is communicated to the base member 12 and the periphery assembly 14 through the universal 26, the shaft 25, and the bevel gear 87. Also mounted on the shaft 25 in the preferred embodiment of the boom 10 is a halyard spool 92 for windingly receiving a halyard attached to the sail 20. In this connection, the fore end of the shaft 25 is preferably of knurled configuration as illustrated at 94 in FIG. 2 and the halyard spool 92 is preferably disengagably secured thereto by means of a clamp 96 which is received on a split sleeve portion 98 of the halyard spool 92. Accordingly, the halyard spool 92 is rigidly securable to the shaft 25 but is adjustable with the clamp 96 to provide a friction brake effect which permits frictional rotation of the spool 92 on the shaft 25. As a result, if circumstances make it necessary to operate the halyard spool 92 independently of the other components of the rotating assembly 16, the spool 92 can be disengaged from the shaft 25 to permit the sail 20 to be raised or lowered with the halyard 116. In this connction, however, the frictional brake effect hereinabove described prevents the spool 92 from spinning freely to provide a degree of control in the lowering of the sail 20.

It is contemplated that the adjustable furling spar of the instant invention will, in most instances, be utilized in combination with a sail of the type illustrated in FIG. 2 having a foreward bolt rope 100 which is slidably receivable in a bolt rope tunnel 102 on the aft side of the mast 18 as illustrated in FIG. 1, the bolt rope 100 and the bolt rope tunnel 102 cooperating to retain the leading edge of the sail 20 adjacent the mast 18. Accordingly, the preferred embodiment of the instant invention further comprises a sail guide 104 to guide the leading edge of the sail 20 from the bolt rope tunnel 102 onto the boom 10. The guide 104 comprises a substantially rigid plate of generally triangular configuration having a bolt rope tunnel 106 along one edge thereof. Hinge elements 108 secure the guide 104 to the lower portion of the mast 18 so that the bolt rope tunnel 106 of the guide 104 communicates with the lower end of the bolt rope tunnel 102 and extends downwardly and rearwardly therefrom terminating in slightly spaced relation above the boom 10.

In the operation of the boom 10 on the boat 22, the sail 20 is secured to the slide rings 24*a* with a plurality of shackles 110 and a line 112 extends from the clue or aft end of the sail 20 around a roller 113 and rearwardly to a cleat 114 on the base member 12 adjacent the aft end thereof to adjustably secure the clue to the aft end of the boom 10. The halyard 116 is secured to the sail 20 for the raising and lowering thereof, and extends through a block 118 on the boat 22 and onto the halyard spool 92.

In use and operation of the adjustable roller furling boom 10, the sail 20 is windingly receivable on the adjustable periphery assembly 14 for reefing or storage of the sail 20. When the boat 22 is operated with the sail 20 in a fully raised disposition wherein it is partially wound on the boom 10, the boom 10 functions as a conventional boom, the sail 20 being secured to the boom 10 along the track 24. However, when it is desired to operate the boat 22 with the sail 20 in a reefed disposition, the boom 10 is operable to compensate for irregular or uneven stretch in the sail 20. Specifically, by adjusting the eye bolt assemblies 32 so that the effective winding cross section of the adjustable periphery assembly 14 is the greatest in those areas of the boom 10 which are directly beneath "baggy" areas of the sail 20, additional tension is applied to the "baggy" areas of the sail 20 as it is wound on the periphery assembly 14, whereby uneven stretch is compensated for and the sail 20 assumes a "flatter" disposition. Normally, adjustments of this nature are required only once a season since the amount of stretch which occurs during the course of a single season is relatively small. However, the assembly 14 is easily adjustable and hence irregular stretch in the sail 20 can be easily compensated for at any time.

Figure 7:
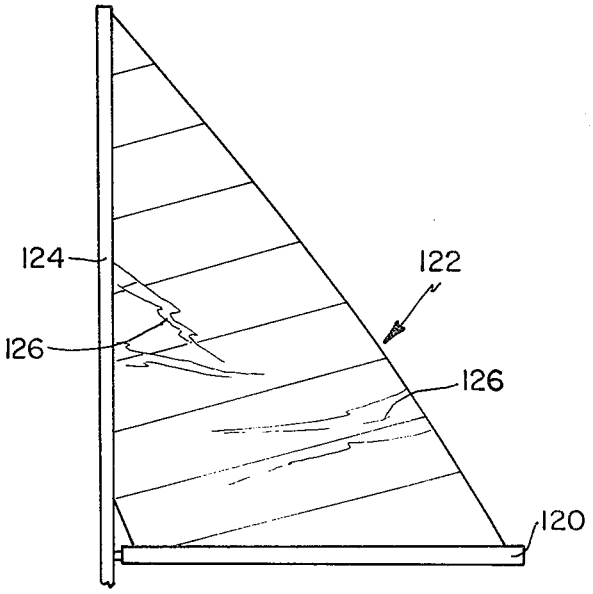
FIG. 7 PRIOR ART
FIGS. 7 and 8 illustrate the operation of a conventional furling boom.
Figure 8:
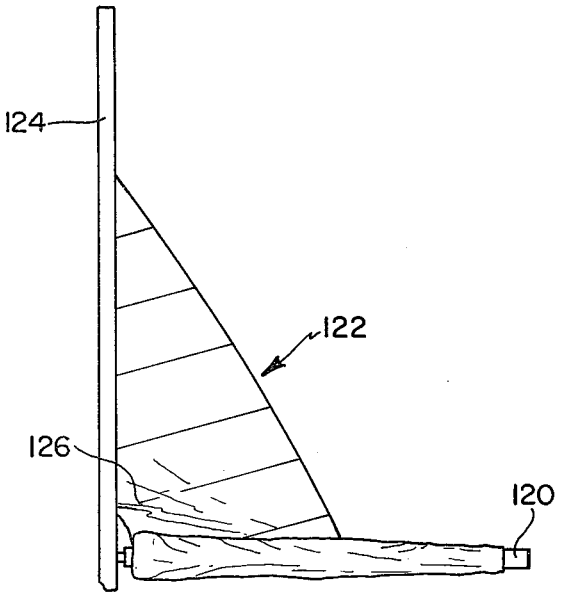
FIG. 8 PRIOR ART
Figure 9:
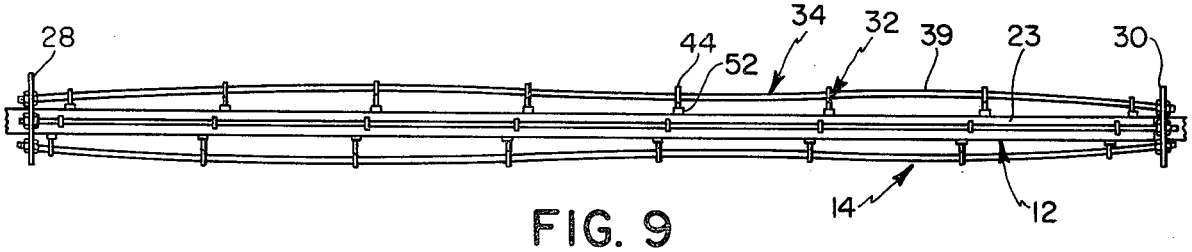
FIG. 9 is a side elevational view of the base member and adjustable periphery assembly of the boom of the instant invention.
Figure 10:
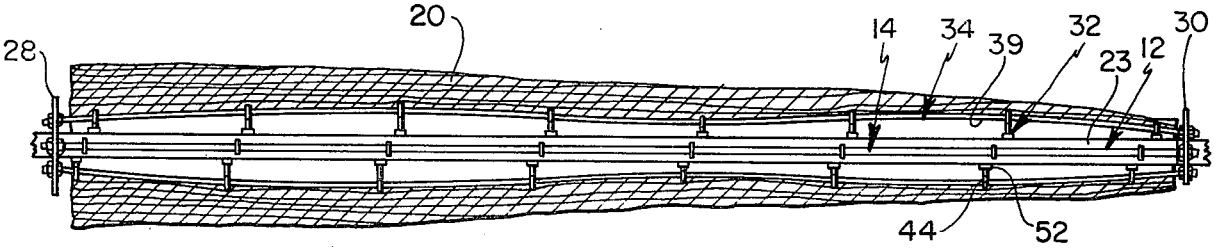
FIG. 10 is a side sectional view thereof with a sail wound thereon.
Figure 11:
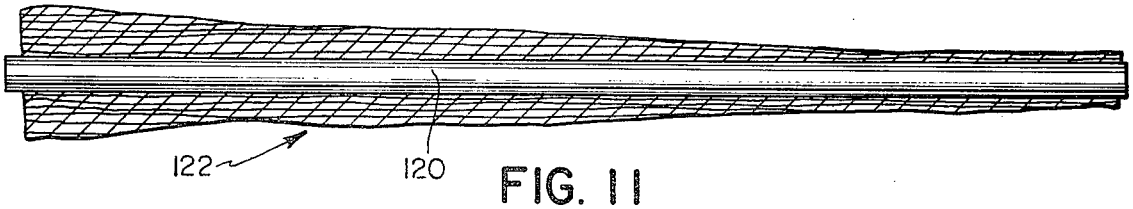
FIG. 11 PRIOR ART
FIG. 11 is a side sectional view of a conventional furling boom with a sail wound thereon.

The operation of a conventional roller furling boom 120 with a sail 122 attached thereto is illustrated in FIGS. 7, 8 and 11, the boom 120 being shown attached to a mast 124 in FIGS. 7 and 8. As will be seen, when the sail 122, which has several "baggy areas" 126, therein is wound onto the boom 120, the "baggy areas" 126 cause the sail 122 to be wound unevenly thereon and the exposed portions of the sail 122 remain fully distorted. In fact, it has been found that in some cases this type of uneven winding can cause the aft end of a boom to be raised or lowered significantly as the various stretched portions of the sail attached thereto are wound thereon. This can make reefing of a badly stretched sail impractical at best. The roller furling boom 10 of the instant invention overcomes this problem by providing an adjustable means for effecting even winding of a badly stretch sail thereon, as illustrated in FIG. 10.

The cowling assembly 64 provides an effective housing for the base member 12 and the adjustable periphery assembly 14. The periphery assembly 14 and the base member 12 are fully rotatable within the cowling 64 for reefing or furling of the sail 20. When sailing the boat 22, the sail 20 may, in some instances, be forced against the upper edge of one of the shell portions 66. However, since the scissor arms 74 and 80 are outwardly yieldable, the appropriate shell portion 66 will yield outwardly to increase the transverse dimension of the opening 72. Normally, the springs 86 retain the lower ends of the shell portions 66 in engagement with the beam element 71 to prevent rattling or shuddering therebetween from the effects of the wind. Furthermore, by disengaging the springs 86, the shell portions are pivotable, as illustrated in FIG. 13, to provide access to the periphery assembly 14 for the adjustment thereof.

The winding assembly 16 is operable by manipulating the worm gear 88 to rotate the bevel gear 77 whereby rotation of the shaft 25 is effected. As is generally known, gear assemblies of this type are characterized by the fact that they can only be operated by rotating the respective worm gears thereof to cause rotation of the bevel gears, but they cannot be operated in reverse by rotating the respective bevel gears thereof to rotate the worm gears. Hence, when the base member 12 and the periphery assembly 14 are rotated to a desired disposition through rotation of the worm gear 88, additional locking means is not required to maintain the assembly 14 and the base member 12 in the desired position since rotational forces applied to the boom 10 cannot cause rotation of the worm gear 88.

As hereinabove set forth, the halyard spool 92 is provided to windingly receive the halyard 116 thereon to raise the sail 20 as it is unwound from the periphery assembly 14. In this regard, the halyard spool 92 is preferably dimensioned so that as the sail 20 is unwound from the assembly 14 the winding of the halyard 116 onto the spool 92 causes the sail 20 to be raised at substantially the same rate as the rate at which it is unwound from the assembly 14. Therefore, in the preferred embodiment, the rotating assembly 16 is operable to simultaneously wind and unwind the sail 20 from the periphery assembly 14, and to raise and lower the sail 20 on the mast 18.

It is seen, therefore, that the instant invention provides an effective adjustable spar which overcomes the problem of stretch in a sail when it is used for reefing. The adjustable periphery assembly provides a novel solution to this problem which has not heretofore been adequately addressed. Further, the cowling assembly 64 provides an effective housing for the base member 12 and the periphery assembly 14, while the rotating assembly 16 provides an effective means for rotating the base member 12 and the periphery assembly 14, as well as for raising and lowering the sail 20. Accordingly, for all of these reasons, as well as the other reasons as hereinabove set forth, the adjustable spar of the instant invention represents a significant advancement in the sailing art which has substantial commercial merit.

While there is shown and described herein certain specific structure embodying the invention, it will be manifest to those skilled in the art that various modificatons and rearrangements of the parts may be made without departing from the spirit and scope of the underlying inventive concept and that the same is not limited to the particular forms herein shown and described except insofar as indicated by the scope of the appended claims.

What is claimed is:

1. An adjustable roller furling spar for a sailboat comprising:

a. an elongated substantially rigid spar base member rotatably securable on said boat;

b. adjustable periphery means attached to said spar base member adjustably defining the effective winding cross section of said spar at a plurality of points spaced along substantially the entire longitudinal extent thereof;

c. means for securing a sail to said spar; and d. means for rotating said spar base member and the periphery means attached thereto and for adjustably securing them in a selected rotated position.

2. The spar of claim 1, further characterized as an adjustable furling boom, said spar base member further characterized as a boom base member rotatably securable on a mast on said boat so that it is universally pivotable relative thereto.

3. In the spar of claim 1, said adjustable periphery means comprising:

a. a flexible elongated rod;

b. means adjustably securing said rod in outwardly spaced relation to said spar base member at a plurality of spaced points there along to adjustably define said effective winding cross section of said spar at said spaced points.

4. In the spar of claim 3, further comprising four of said rods spaced around said spar base member.

5. In the spar of claim 2, said sailing securing means comprising track means on said spar base member for securing a sail thereto.

6. In the spar of claim 3, said rod securing means comprising a plurality of substantially aligned eye bolt members adjustably received in threaded engagement in said spar base member at said spaced locations, said rod extending through the openings in said eye bolt members.

7. In the spar of claim 6, said rod being of at least slightly adjustable length and being slidably received in said eye bolt member openings, said rod securing means further comprising retaining means secured to said spar base member for retaining the ends of said rods adjacent said spar base member.

8. In the spar of claim 7, said retaining means comprising a pair of retaining plates, one of said plates being secured to said spar base member adjacent each end of said rod, said rod comprising an elongated tubular member and a pair of slide members, one of said slide members being slidably received in each end of said rod to effect said adjustability in the length thereof and being longitudinally retained adjacent the respective plate.

9. The spar of claim 6, further comprising a plurality of sleeve elements rotatably secured in substantially radial relation in said spar base member and having longitudinal threaded openings therein, said eye bolt members being threadedly received in said sleeve element openings to threadedly secure said eye bolt members to said spar base member, whereby said eye bolt members are adjustable by rotation of said sleeve elements.

10. The spar of claim 9, further comprising a plurality of socket elements secured in said spar base member, said sleeve elements being rotatably secured in said socket elements.

11. The spar of claim 2, further comprising a cowling, said cowling comprising:

a. a pair of elongated substantially rigid shell portions; and b. means mounting said shell portions on opposite sides of said spar so that they cooperate to define an elongated housing which is outwardly spaced from said periphery means, the upper portions of said shell portions being in spaced relation to define an elongated longitudinal opening in said housing for receiving said sail on said spar, said mounting means mounting said shell portions so that at least one thereof is resiliently pivotable outwardly about a longitudinal axis relative to said cowling to increase the transverse dimension of said opening.

12. In the spar of claim 11, both of said shell portions being pivotable, said shell portion mounting means comprising:

a. a pair of scissor arms adjacent each end of said cowling and secured to said spar base member so that said arms are transversely pivotable relative thereto; and b. means retaining each pair of said scissor arms so that they extend generally upwardly and outwardly in a V-shaped configuration wherein said arms are resiliently outwardly pivotable to increase the angle defined therebetween, each of said halves being pivotally suspended from the outwardly extending portions of the two arms on the same respective side of said spar adjacent the opposite ends of said cowling and extending downwardly therefrom.

13. The spar of claim 12, further comprising:

a. an elongated beam element mounted in spaced relation below said adjustable periphery means, the lower portions of said shell portions being engageable with said beam element; and b. detachable means resiliently urging the lower portions of said shell portions toward said beam element.

14. A cowling for a roller furling boom for a sail boat and the like comprising:

a. a pair of elongated substantially rigid shell portions; and b. means mounting said shell portions on opposite sides of said boom so that they cooperate to define an elongated housing which is outwardly spaced from a sail attached to said boom when said sail is windingly received thereon, the upper extremities of said shell portions being in spaced relation to define an elongated longitudinal opening in said housing for receiving a sail on said boom, said mounting means mounting said shell portions so that at least one of said shell portions is resiliently pivotable outwardly about a substantially longitudinal axis which is adjacent the lower end thereof to increase the transverse dimension of said opening and so that at least one of said shell portions is outwardly pivotable about a substantially longitudinal axis which is adjacent the upper end thereof to provide access to the interior of said cowling.

15. In the cowling of claim 11, both of said shell portions being pivotable, said shell portion mounting means comprising:

a. a pair of pivot arms adjacent each end of said cowling secured to said boom so that said arms are transversely pivotable relative thereto; and b. means retaining each pair of said pivot arms so that they extend generally upwardly and outwardly in a V-shaped configuration wherein said arms are resiliently outwardly pivotable to increase the angle defined therebetween, each of said halves being pivotally suspended from the outwardly extending portions of the two arms on the same respective side of said boom adjacent opposite ends of said cowling and extending downwardly therefrom.

16. The cowling of claim 15, further comprising:

a. an elongated beam element mounted in spaced relation below said base member, the lower portions of said shell portions being engageable with said beam element; and b. means resiliently urging the lower portions of said shell portions toward said beam element.

17. The boom of claim 2, in combination with a mast having a bolt rope tunnel therein, said boom being secured to said mast so that it is universally pivotable relative thereto, and a sail guide, said guide comprising:

a. a substantially rigid generally triangular plate portion having a bolt rope tunnel along one edge thereof; and b. means pivotally securing said plate portion to the rear side of said mast in closely spaced relation above said boom so that said plate portion is pivotable about an axis which is substantially parallel to the axis of said mast and so that said plate portion bolt rope tunnel communicates with said mast bolt rope tunnel and extends downwardly and generally rearwardly therefrom terminating in closely spaced relation above the fore end of said adjustable periphery means, whereby said guide is operable to guide the fore edge of a sail, of the type having a forward bolt rope, onto said periphery means.

18. A sail guide for a sail boat of the type having a bolt rope tunnel along the aft side of the mast thereof and a boom having a rotatable furling mechanism comprising:

a. a substantially rigid, generally triangular plate portion having a bolt rope tunnel along one edge thereof; and b. means pivotally securing said plate portion to the rear side of said mast in closely spaced relation above said boom so that said plate portion is pivotable about an axis which is substantially parallel to the axis of said mast and so that said plate portion bolt rope tunnel communicates with the lower portion of said mast bolt rope tunnel and extends downwardly and generally rearwardly therefrom terminating in closely spaced relation above the fore end of said furling mechanism, whereby said guide is operable to guide the fore edge of a sail, of the type having a forward bolt rope, onto said furling mechanism.

19. The boom of claim 2, further comprising a rotatable shaft which is mountable on said mast so that it extends therethrough, said boom base member being secured to the rear end of said rotatable shaft so that it is universally pivotable relative thereto, said rotating means communicating with said rotatable shaft in front of said mast to rotate said boom.

20. In the boom of claim 19, said rotating means comprising a bevel gear mounted on said rotatable shaft and a rotatable worm gear mounted in communication with said bevel gear to effect rotation thereof.

21. The boom of claim 20, in combination with a halyard spool mounted on said rotatable shaft forward of said mast for windingly receiving a halyard attached to said sail thereon upon rotation of said shaft to unwind said sail from said boom, said spool being dimensioned so that as said sail is unwound from said boom, it is raised up said mast by said halyard at substantially the same rate at which it is unwound from said boom.

22. In the combination of claim 21, said halyard spool being disengageably mounted on said rotatable shaft to permit rotation of said spool relative to said rotatable shaft.

* * * * *